United States Patent [19]

Herrington

[11] Patent Number: 4,955,175

[45] Date of Patent: Sep. 11, 1990

[54] TWO-STAGE BOX PUSHER FOR CARTON INDEXER

[75] Inventor: Fox J. Herrington, Holcomb, N.Y.

[73] Assignee: Mobil Oil Corporation, New York, N.Y.

[21] Appl. No.: 306,015

[22] Filed: Feb. 6, 1989

[51] Int. Cl.[5] ..... B65B 43/42

[52] U.S. Cl. ..... 53/67; 53/250; 53/252; 198/447

[58] Field of Search ..... 53/252, 251, 250, 249, 53/564, 67, 52, 53; 198/447, 445, 451, 436, 427, 416, 358; 414/781, 783, 757

[56] References Cited

U.S. PATENT DOCUMENTS

| | | | |
|---|---|---|---|
| 2,804,961 | 9/1957 | Carter | 198/447 |
| 2,953,234 | 9/1960 | Abendschein | 198/447 |
| 3,036,689 | 5/1962 | Carter | 198/358 X |
| 3,122,231 | 2/1964 | Pence et al. | 198/358 X |
| 3,144,119 | 8/1964 | Nigrelli et al. | 198/451 X |

*Primary Examiner*—James F. Coan

*Attorney, Agent, or Firm*—Alexander J. McKillop; Charles J. Speciale

[57] ABSTRACT

An apparatus for the sequential loading of a plurality of cartons with articles, such as plastic bags and the like, and more particularly, an indexing system for such an apparatus to increase the rate of feed of the cartons to bag-loading stations which are contained in the apparatus.

14 Claims, 2 Drawing Sheets

TWO-STAGE BOX PUSHER FOR CARTON INDEXER

BACKGROUND OF THE INVENTION

1. Field of the Invention

The present invention relates to an apparatus for the sequential loading of a plurality of cartons with articles, such as plastic bags and the like, and more particularly, pertains to an indexing system for such an apparatus to increase the rate of feed of the cartons to bag-loading stations which are contained in the apparatus.

The folding and loading of thin, limp, sheet-type articles such as, for instance, plastic trash bags, produce bags, sandwich bags or general utility bags into box-like containers through the intermediary of high-speed, automatic machines is well known in the packaging technology. These plastic bags are folded and loaded into cartons which may contain, for example, from 10 or 20 to up to 75 or 150 or even more of such bags for retail sale thereof.

At this time, numerous types of apparatus and equipment for the production of cartons are widely available in industry and possessed of a high production capability. Similarly, carton closing apparatus which is presently available also possesses a high production capacity. In the installation of a system for filling such cartons; for instance, with plastic bags; the production requirements are frequently quite lower than the capacity of the carton forming and closing equipment. Consequently, equipment designers are frequently faced with the problem of providing expensive carton loading or filling devices which can operate up to the capacity of the carton forming apparatus, or alternatively, providing less complex and expensive carton forming apparatus of only the capacity which is required by the particular situation. Upon selecting the latter option, after a few years the requirements may quite frequently increase beyond the capacity of the carton loading equipment, thereby rendering the system uneconomical and possibly even completely obsolescent.

2. Discussion of the Prior Art

A modular carton loading equipment which can be easily expanded by adding box loading equipment as needed to the system has been already developed and disclosed in applicant's copending U.S. patent application Ser. No. 654,360, filed Sept. 26, 1984, assigned to the common assignee of this application, and which is incorporated herein by reference.

Another application discloses a modular indexing table for a carton loading machine which is modular in nature, as is disclosed in applicant's copending U.S. patent application Ser. No. 707,227, filed Mar. 1, 1985 assigned to the common assignee of this application, and which is also incorporated herein by reference.

SUMMARY OF THE INVENTION

Accordingly, it is an object of the present invention to provide an improved and novel indexing table arrangement for carton loading apparatus which are modular in nature and which can be easily interconnected in the system with increased capacity, and wherein empty cartons are pushed from a main line conveyor to a separating conveyer with the interposition of an intermediate station holding the cartons in a state of readiness so as to await their need by a loading station of the system.

It is another object of the present invention to provide an indexing table for bag loading apparatus incorporating a two-stage carton pusher system which perform its functions reliably, has high durability, and considerably increases the output rate of a carton loading system.

In accordance with the present invention, an indexing table for carton loading apparatus has a first main line conveyor which transports empty open cartons across the indexing table. This first main line conveyor is adapted to be optionally extended by adding additional tables to the system in a modular expansion of the system. The empty cartons are diverted from the first main line conveyor to an intermediate station to await their being advanced as needed onto a separating or indexing conveyor which transports groups of cartons to a carton filling or loading machine. After loading, the filled cartons are moved to a second main line or full carton conveyor which extends completely across the table. This full carton conveyer can be extended in a manner similar to the first main line conveyor by adding additional tables in a modular mode so as to increase the overall capacity of the system. It is possible to arrange a system of interconnected tables in this manner, each having the capability of servicing carton loading machines of a predetermined capacity.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
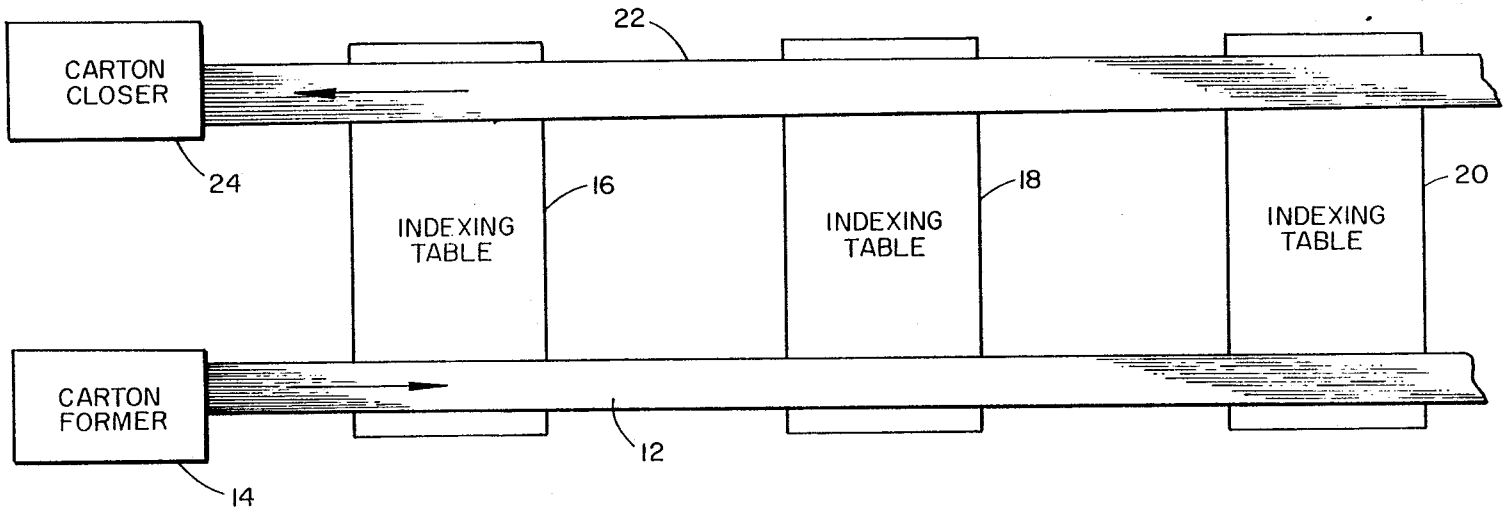
FIG. 1 illustrates a carton loading system including a plurality of indexing tables connected in sequence pursuant to the present invention.

Referring to FIG. 1, a main line conveyor 12 transports empty cartons from a carton former 14 to a plurality of sequentially positioned indexing tables 16, 18 and 20 pursuant to the present invention. The main line conveyor 12 extends across each indexing table so that the indexing tables can be easily interconnected in successive modular arrangement and the capacity of the box-loading system can be expanded in conformance with commercial needs. In the exemplary embodiment, up to ten indexing tables can be supplied with empty cartons from a common carton-forming machine.

Similarly, a full-box or carton main line conveyor 22 extends across all of the indexing tables and feeds loaded cartons back towards a carton closer 24.

Each indexing table includes equipment for holding in readiness an thereafter sequentially pushing groups of empty boxes from the main line conveyor 12 and transporting them to loading or filling machines on the indexing table. Each indexing table also includes devices for merging the loaded cartons from the loading machines onto the full-box main line conveyor 22 so that they can be returned to the carton closer.

Figure 2:
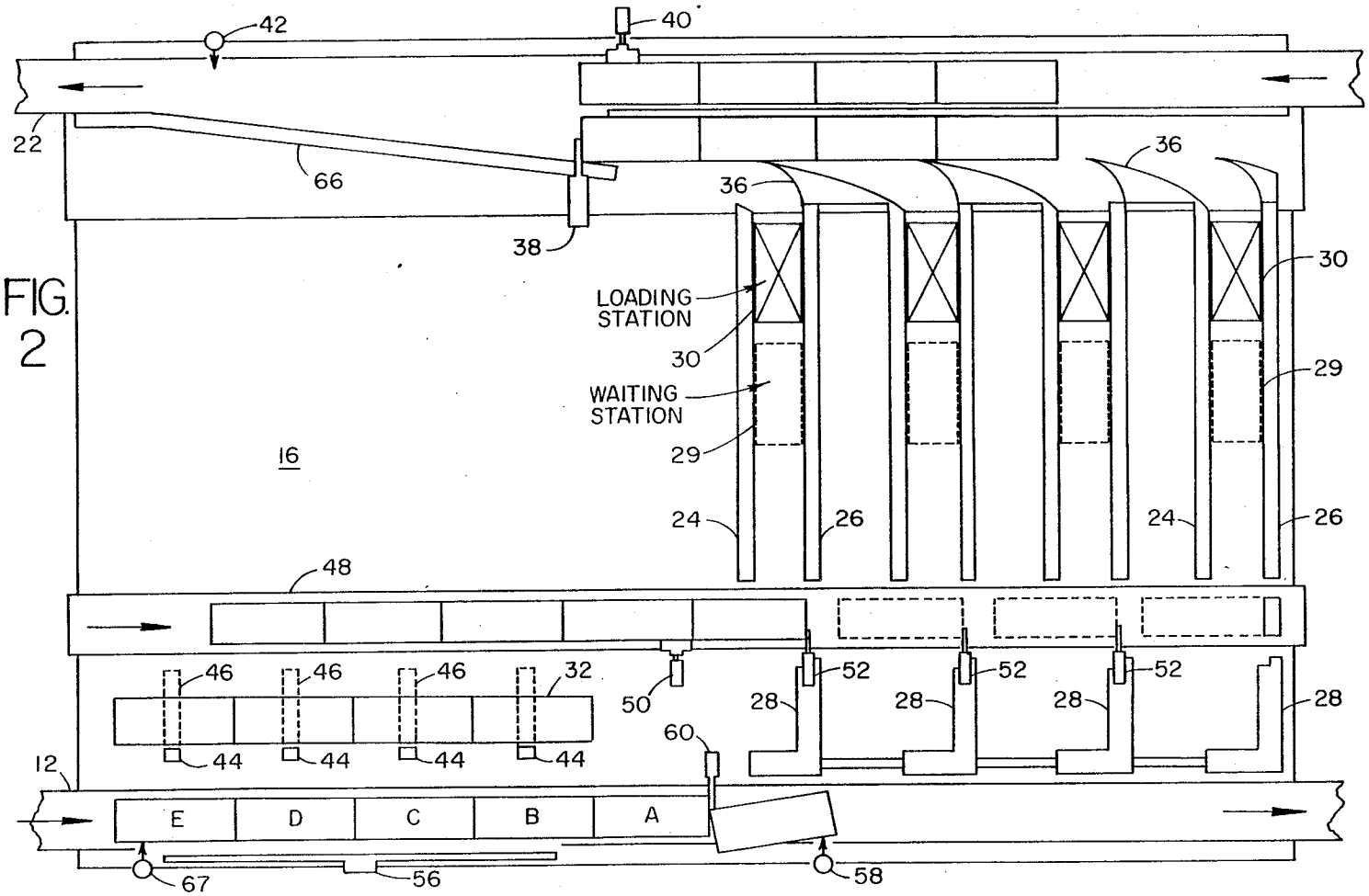
FIG. 2 illustrates, generally diagrammatically, a top plan view of the indexing table of the present invention.

Referring to FIG. 2 of the drawings, there is shown a simple indexing table 16 arranged between the two main line conveyors 12 and 22. The empty-carton main line conveyor 12 is supplied with empty cartons from the left by the carton former 14 (not shown) such as a Peters carton former. To the right, this main line conveyor leads to another identical indexing table 18 (not shown). The full carton main line conveyor 22 transports filled cartons from the right and conveys them to the carton closer (not shown), at the left. The function of the indexing table is to remove empty cartons from the main line conveyor 12 in groups of two (food bags) or four (sandwich bags), place them at an intermediate station in a state of readiness for a separating conveyor to sequentially advance them to the loading station where they are filled with bags, then merge the full cartons with those transported past on the main line conveyor 22 from other indexing tables.

Operating Cycle

The operation and components are now described commencing at the point where there are empty cartons (shown dotted) at the waiting station between guide rails 24, 26. The indexer 28 is displaced forwardly from where it is shown, i.e. in contact with the cartons at the waiting station 29. Bags are being loaded into the cartons at the loading station 30. Empty cartons are held in readiness at the intermediate station 32 on the table. When the desired bag count has been reached, the indexer 28 moves forward rapidly, pushing empty cartons from the waiting station 29 into the loading station 30, and those new cartons push the filled cartons out onto the full-carton main line conveyor 22 where they are turned by the turning vanes or plates 36 and are stopped by a blocker 38 waiting to be merged.

At this time, simultaneously, the full cartons are merged on conveyor 22, and new cartons are brought up from the intermediate station 32 to the waiting station 29.

Referring first to the carton merging sequence on conveyor 22:

As soon as a fast index has occurred, a squeezer 40 extends, stopping the travel of full carton along the main line conveyor 22. Sufficient time is allowed to pass (about 1.5 sec.) to be sure that any carton that were past squeezer 0 have had time to reach an eye 42. The eye 42 looks for a carton, and as soon as it sees no carton it is certain that the merging area is clear (no downstream holdup), and blocker 8 is retracted, releasing the new carton to merge onto the main stream on conveyor 22. Again the timer waits to be sure the new boxes have reached eye 42, then the eye looks and when failing to ascertain a carton it releases squeezer 40 so the main line conveyor 22 can resume its flow of passing cartons. Blocker 38 extends and is ready for the next group of filled cartons.

Reverting to the supply of new cartons, after fast index has occurred, the indexer 28 retracts slowly to the position at which it is shown. A second pusher 44 consists of a group of lugs on a chain (not shown) under the table. As the chain is moved, the lugs come up through slots 46 in the table and push the cartons from the intermediate station 32 onto the separating conveyor 48. Second pusher 44 retracts back below the surface of the table, and again two things happen simultaneously. The cartons on the separating conveyor 48 are moved to the waiting station 29, and the intermediate station 32 is refilled with empty cartons. Followed first hereinbelow are the cartons on the separating conveyor 48.

In its rest position, a squeezer 50 is retracted and blockers 52 are extended. They are operatively interconnected so that squeezer 50 extends every time blockers 52 retract and vice versa. After pusher 44 cycles, sufficient time is allowed for the cartons to reach the first blocker 52, as shown in the drawing. Then blocker 52 retracts allowing the first carton to advance, while squeezer 50 has extended, thereby preventing the remainder of the cartons from moving. Sufficient time is allowed for the rear edge of the carton to have moved past the first blocker 52, but not enough time for its front edge to reach the second blocker; then the blockers 52 are extended and squeezer 50 is released. Sufficient time is allowed for the remaining group of cartons to advance to the first blocker. The cycle is then repeated until all of the cartons are spaced apart along the separating conveyor 48 as shown by the dotted line. At this time the indexer 28 advances slowly pushing the front edge of each carton into the channel between guide rails 24, 26 leading to the waiting station 29. The simultaneous movement of the separating conveyor 48 to the right assures that the rear edge of the carton will move sideways, turning the box 90°. When slow index of indexer 28 has reached the waiting station 29, it stops and waits for the bag count, at which time the indexer advances rapidly and the cycle repeats.

Meanwhile, in view of the foregoing, the intermediate station 32 is now in need of new empty cartons. After pusher 44 has cycled, as soon as containers are available in front of first pusher plate 56, then the latter cycles, moving four (or two) boxes from the main line conveyor 12 to the intermediate station 32.

Following is a description in the manner the apparatus knows when boxes or cartons are available in front of first pusher plate 56. On the empty box main line conveyor 12, whenever an eye 58 sees a carton, a kicker 60 extends, blocking the following carton while still allowing the carton ascertained by eye 58 to advance. In that way, if the conveyor 12 is full downstream, the eye 58 will continuously see a carton, and the following cartons will be positioned in a definite location. When an eye 62 sees a carton, it knows a carton to be approximately in position E in front thereof, but does not know there are cartons in positions A to D. However, if eye 62 has ascertained a box continuously for enough time for the conveyor 12 to travel from eye 62 to the kicker 60, and if kicker 60 has been extended continuously for all of that time, then the eye is certain that there are cartons precisely in positions A through E. At that point, pusher plate 56 extends, pushing carton from positions B through E to the intermediate station 32. A negator spring, such as a retractable steel scale (not shown), which is attached to the upstream end of the pusher plate 56 prevents cartons from entering behind the pusher plate while the latter is extended.

On a sandwich bag indexer there is no intermediate station 32, and no second pusher 44, but instead pusher plate 56 moves the cartons all the way across to the separating conveyor 48, as described in copending U.S. application Ser. No. 707,227. This simplification is possible because of the larger bag count on sandwich bags. With an 80 count of bags, there is available about 70 seconds before the loading station 30 is ready for more cartons, and this is sufficient time to wait for cartons to be available at pusher plate 56, move them across, separate and turn them. With the smaller good bag count, the available time might be as short as 20 seconds, and the arrangement described herein allows that full time for waiting for carton to be available at pusher plate 56.

The diagonal fence or rail 66 extending partially across the main line conveyor 22, the full cartons to merge, can be shifted so it extends in parallel with the edges of the conveyor 22 and separates the new filled cartons from the main line. This may be effected by an air cylinder (not shown) controlled by a suitable switch on the main control panel labelled "Rejector". When in this position, the fence 66 rejects product from this line and does not merge it with the good product. This should be used during start-up or if the line is temporarily making bag product.

Although each main line conveyor 12, 22 functions as a continuous belt, it is mechanically divided at the edges of the indexing table. One belt covers the length of the indexer table, and separate connecting conveyors (not shown) are used between subsequent indexing tables. One AC motor drives all three belts 12, 22, 48 on the indexing table. Each of the connecting conveyors is driven by a short timing belt from the indexing table, so as to eliminate the need for separate motors. Thus each conveyor line is a completely autonomous unit, and is not tied to other conveyor lines. When expanding a module for adding a conveyor line, then a new pair of connecting conveyors are added, and they function as a part of the new line.

The indexing table serves as the main platform to which the other parts of the bag-making system are attached. The main control panel, and most of the pneumatic circuitry, are structurally part of the indexer.

While there has been shown and described what are considered to be preferred embodiments of the invention, it will, of course, be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. In an apparatus for the loading of a plurality of box-like cartons with articles including at least one indexing table for delivering cartons to and from a loading machine, the improvement comprising: a first conveyor for transporting empty boxes across said indexing table; a separating conveyor for transporting empty containers to a loading machine for said table; an intermediate station for said cartons between said first conveyor and said separating conveyor; first pusher means for pushing said cartons from said first conveyor to said intermediate station; second pusher means for pushing said cartons from said intermediate station onto said separating conveyor; an indexer for aligning said boxes at said loading machine; a second conveyor for transporting loaded boxes from said loading machine across said table; and means for merging loaded boxes from the machine on said table with a line of loaded boxes on said second conveyor.

2. An apparatus as claimed in claim 1, including a plurality of said indexing tables, a box-forming machine, a box-closing machine, and a box-loading machine for each indexing table, said first conveyor and said second conveyor being continuous from table to table so that said box-forming machine and said box-closing machine service a plurality of said indexing tables.

3. An apparatus as claimed in claim 1, wherein said first pusher means sequentially pushes groups of empty boxes from said first conveyor to said intermediate station and said second pusher means from said intermediate station onto said separating conveyor; including a plurality of said loading machines, one for each carton in a group.

4. An apparatus as claimed in claim 3, comprising a separator on said separating conveyor between said second pusher means and said indexer for separating the cartons of a group on said conveyor.

5. An apparatus as claimed in claim 4, wherein said separator comprises a blocker selectively actuated in response to the speed of said separator conveyor belt for stopping the movement of a carton in the front of one of a plurality of said loading machines.

6. An apparatus as claimed in claim 4, wherein said separator comprises a squeezing mechanism which is selectively actuated in response to the speed of movement of said separating conveyor for holding one of said cartons stationary until it is properly spaced from another carton in said group.

7. An apparatus as claimed in claim 3, comprising an optical sensor on said first conveyor, said first pusher means being responsive to said optical sensor for pushing said groups of boxes from said first conveyor to said intermediate station.

8. An apparatus as claimed in claim 3, wherein said indexer comprises an index plate which moves across said separating conveyor, the movement of said plate and the movement of said separating conveyor turning said cartons from a lengthwise orientation along said separating conveyor to a lengthwise orientation across said separating conveyor.

9. An apparatus as claimed in claim 3, wherein rails which extend from said indexer beneath said plurality of loading machines guide each carton of a group between the rails of one loading machine.

10. An apparatus as claimed in claim 9, wherein said indexer moves said group of cartons to a waiting position in front of said loading machine and then moves said cartons under said loading machines for loading.

11. An apparatus as claimed in claim 10, wherein the movement of said cartons from said waiting positions to a position under said loading machines pushes loaded boxes onto said second conveyor.

12. An apparatus as claimed in claim 11, comprising turning plates on said second conveyor, said turning plates having a curvature which turn said carton from a lengthwise orientation across said second conveyor to a lengthwise orientation along said second conveyor.

13. An apparatus as claimed in claim 1, wherein said means for merging include a squeezing mechanism for holding said line of loaded cartons on said second conveyor; and a blocker mechanism for holding full cartons from the loading machines on said indexing table until said table is clear.

14. An apparatus as claimed in claim 13; comprising: an optical sensing device for sensing the absence of loaded cartons on said second conveyor, said blocker mechanism releasing said full cartons from the loading machines in response to said optical sensing device.

* * * * *